United States Patent [19]

Tanahashi

[11] Patent Number: 4,671,389

[45] Date of Patent: Jun. 9, 1987

[54] SPEED CONTROL APPARATUS FOR AN ELEVATOR

[75] Inventor: Tooru Tanahashi, Inazawa, Japan

[73] Assignee: Mitsubishi Denki Kabushiki Kaisha, Tokyo, Japan

[21] Appl. No.: 859,313

[22] Filed: May 5, 1986

[30] Foreign Application Priority Data

May 9, 1985 [JP] Japan ..... 60-98634

[51] Int. Cl.[4] ..... B66B 1/30

[52] U.S. Cl. ..... 187/119; 318/798

[58] Field of Search ..... 187/29; 318/798–802, 318/805, 806

[56] References Cited

U.S. PATENT DOCUMENTS

| | | | |
|---|---|---|---|
| 4,451,770 | 5/1984 | Boettner et al. | 318/806 X |
| 4,475,631 | 10/1984 | Nomura | 187/29 R |
| 4,519,479 | 5/1985 | Tanahashi | 187/29 R |
| 4,546,301 | 10/1985 | Tinebor et al. | 318/798 |
| 4,567,419 | 1/1986 | Watanabe | 318/798 |
| 4,576,253 | 3/1986 | Tanahashi et al. | 187/29 R |
| 4,602,702 | 7/1986 | Tanahashi | 187/29 R |
| 4,624,343 | 11/1986 | Tanahashi et al. | 187/29 R |

FOREIGN PATENT DOCUMENTS 56-123795 9/1981 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A speed control apparatus for an elevator utilizing variable command values of the primary current of an induction motor for controlling the operation of the motor. When the cage is running at a rated speed, the terminal voltage of the induction motor is detected and supplied to a microcomputer to calculate an exact secondary resistance with respect to the temperature condition of the induction motor so as to determine the aforementioned command value of the primary current that is necessary for high speed precision control.

8 Claims, 5 Drawing Figures

SPEED CONTROL APPARATUS FOR AN ELEVATOR

BACKGROUND OF THE INVENTION

This invention relates to a speed control apparatus for an elevator which corrects the secondary resistance of an induction motor in consideration of the temperature state thereof and can perform a speed control of high precision.

Heretofore, a conventional speed control apparatus for an elevator as shown in FIG. 5 has been proposed (Japanese patent application Laid-open No. 56-123795). In this speed control apparatus for an elevator, an inventer device for driving an A-C motor is employed for controlling the operation of the A-C motor. Referring to FIG. 5, numeral 1 designates an A-C power source of three-phase alternating current, numeral 2 a thyristor converter which converts the alternating current from the A-C power source 1 into direct current, and numeral 3 a smoothing capacitor which smooths the output voltage of the thyristor converter 2. The direct current produced by the thyristor converter 2 as well as the smoothing capacitor 3 is applied to a transistor inverter 4, in which the direct current is inverted into an alternating current. This alternating current is supplied as a primary current to an induction motor 6 for moving a cage, and is detected by a current detector 5.

Shown at numeral 7 is a suspension pulley, which is connected to the rotary shaft of the induction motor 6 through a speed detector 8 so as to be freely rotated by the operation of the induction motor 6. Wound round the suspension pulley 7 is a traction rope 11 to which the aforementioned cage 9 and a counterweight 10 are fixed. The rotation of the suspension pulley 7 runs the cage 9.

Numeral 12 indicates a pattern generating device which outputs a speed pattern command. Numeral 13 indicates a microcomputer, into which the output of the pattern generating device 12 and the output of the speed detector 8 are fed through an interface circuit. A PWM (pulse width modulation) circuit 14 compares an output from the microcomputer 13 and an output from the current detector 5, and subjects the difference to the PWM. Thus, it applies a control signal to the base of the transistor of each phase in the transistor inverter 4 so as to control the primary current.

With the speed control apparatus for an elevator as described above, when the cage 9 of the elevator is to be run, the microcomputer 13 first executes a calculation for the PI (proportional-plus-integral) control of the induction motor 6 on the basis of the output of the pattern generating device 12 and that of the speed detector 8 and evaluates a torque command. Further, in order to perform the so-called vector control in which the magnetic flux of the induction motor 6 is held constant, the microcomputer 13 calculates the command value of the primary current in accordance with equations to be mentioned below and converts it into an analog signal which is applied to the PWM circuit 14.

More specifically, letting $T_e$ denote the torque command obtained by the PI control calculation of the microcomputer 13, a slip frequency command $\omega_s$ is evaluated as:

$$\omega_s = \frac{T_e}{m \times \frac{P}{2} \times L_o \times \frac{L_o + l_2}{r_2} \times I_E^2} \tag{1}$$

A torque current component $I_T$ is evaluated as:

$$I_T = \frac{L_o + l_2}{r_2} \times I_E \times \omega_s \tag{2}$$

Here, m: number of phases, P: number of poles, Lhd O: excitation inductance, $l_2$: secondary leakage inductance, $r_2$: secondary resistance, and $I_E$: excitation current.

Accordingly, the command values of the primary currents which are output by the microcomputer 13 are given as follows:

Current Value $I_1 = \sqrt{I_E^2 + I_T^2}$ (3)

Phase $\theta = \int (\omega_r + \omega_s)dt$ ($\omega_r$: rotational angular velocity) (4)

$$\left.\begin{aligned} &U\text{-phase} && i_U^* = \sqrt{2}\, I_1 \sin\theta dt \\ &V\text{-phase} && i_V^* = \sqrt{2}\, I_1 \sin(\theta - \tfrac{2}{3}\pi)dt \\ &W\text{-phase} && i_W^* = \sqrt{2}\, I_1 \sin(\theta + \tfrac{2}{3}\pi)dt \end{aligned}\right\} \tag{5}$$

As described above, the prior-art speed control apparatus for the elevator has calculated the command value of the primary current with the resistance $r_2$ of the secondary coil of the induction motor 6 deemed constant. In practice, however, the resistance $r_2$ of the secondary coil of the induction motor 6 changes greatly depending upon temperatures. This has incurred the problem that, when the temperature of the secondary coil is low, the induction motor comes to have an insufficient torque, whereas when it is high, the motor is overexcited, so a speed control suited to an actual operation cannot be performed.

SUMMARY OF THE INVENTION

This invention has been made in order to solve such a problem, and has for its object to provide a speed control apparatus for an elevator which prevents the insufficient torque and overexcitation of an induction motor for operating a cage and can perform a speed control of high precision.

In a speed control apparatus for an elevator wherein when a cage is run, the command value of the primary current of an induction motor is calculated by a microcomputer so as to control the cage, the speed control apparatus for an elevator according to this invention is so constructed that a voltage detector for detecting the terminal voltage of the induction motor is disposed to feed the microcomputer with the terminal voltage of the induction motor while the cage is running at a rated speed, whereby an exact secondary resistance with respect to the temperature condition of the induction motor is taken into consideration so as to calculate the aforementioned command value of the primary current with respect to this secondary resistance.

In this invention, in calculating the command value of the primary current which controls the operation of the induction motor, the actual secondary resistance of the operating induction motor is evaluated and is used for the calculation, thereby to obtain the command value of the primary current at high precision.

BRIEF DESCRIPTION OF THE DRAWINGS

In the drawings, the same symbols indicate identical or corresponding portions.

DESCRIPTION OF THE PREFFERED EMBODIMENT

Now, an embodiment of this invention will be described with reference to the drawings.

Figure 1:
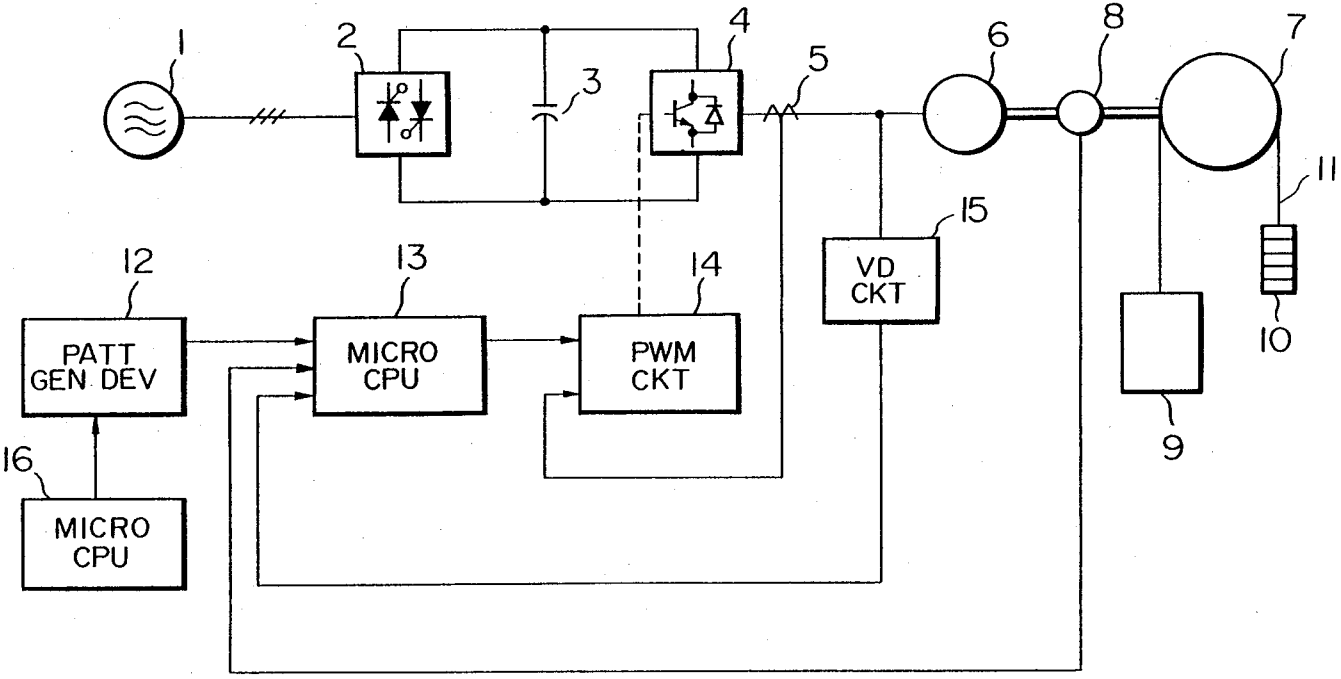
FIG. 1 is a block diagram of a speed control apparatus for an elevator according to this invention.

FIG. 1 is a circuit diagram of one embodiment of a speed control apparatus for an elevator according to this invention, in which numerals 1–14 designate quite the same portions as in the prior-art apparatus. Numeral 15 designates a voltage detector circuit which detects the terminal voltage of the induction motor 6, the output of which is fed into the microcomputer 13 through the interface circuit.

Figure 2:
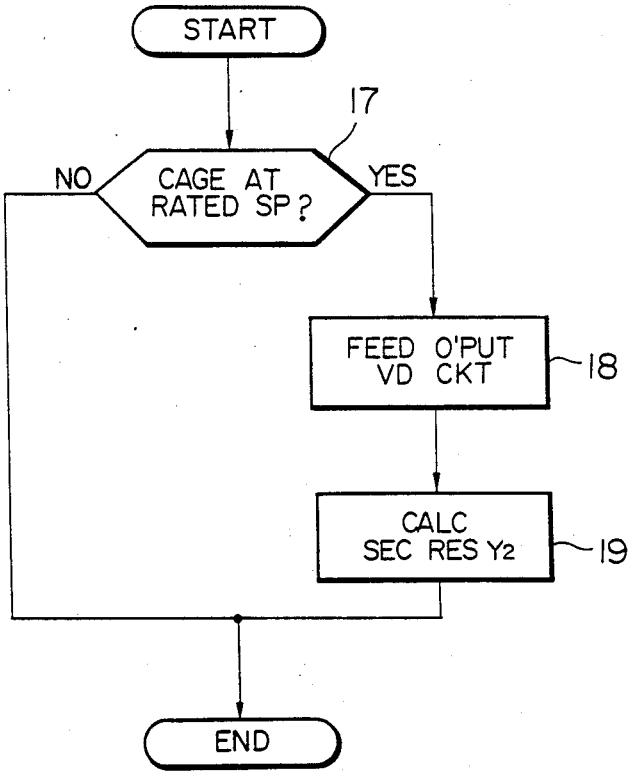
FIG. 2 is a flow chart of a routine for calculating a secondary resistance.

The speed control apparatus for the elevator having the above construction operates as stated herebelow. In the presence of a call for the cage, the microcomputer 13 evaluates the torque command $T_e$ and further obtains the command value of the primary current in each phase on the basis of Eqs. (1)–(5). At this time, the resistance $r_2$ of the secondary coil for use in Eqs. (1) and (2) is one calculated by the microcomputer 13 on the basis of the output of the voltage detector circuit 15. More specifically, as indicated by a flow chart of FIG. 2, whether or not the cage 9 is running at a rated speed is decided (step 17). When the cage is running as rated, the output of the voltage detector circuit 15 is fed into the microcomputer 13 (step 18), and the microcomputer 13 calculates the secondary resistance $r_2$ (step 19). The step of calculating the secondary resistance $r_2$ is as explained below.

When the primary current command value $\dot{I}_1^*$ has been given by the equation (3) mentioned before, the phase voltage $\dot{V}$ of the induction motor 6 is as follows, subject to the running of the cage at the rated speed:

$$\dot{V}=(j\omega_0 l_1+r_1)\,\dot{I}_1+j\omega_0 L_0 \dot{I}_0 \qquad .....(6)$$

In addition, $$\dot{I}_1 = \dot{I}_o + \dot{I}_o \qquad (7)$$

$$j\omega_o L_o \dot{I}_o = \left(j\omega_o l_2 + \frac{\omega_o}{\omega_s} r_2\right) \dot{I}_2 \qquad (8)$$

Here, $l_1$: primary leakage inductance, $r_1$: primary resistance, $\omega_0$: inverter output frequency, $\omega_s$: inverter slip frequency, and $I_0$: excitation current.

Accordingly, the substitution of Eqs. (7) and (8) into Eq. (6) results in:

$$\dot{V} = (j\omega_o l_1 + r_1)\dot{I}_1 + \frac{j\omega_o L_o}{1 + \dfrac{j\omega_o L_o}{j\omega l_2 + \dfrac{\omega_o}{\omega_s} r_2}} \dot{I}_1 \qquad (9)$$

so that the voltage $\dot{V}$ can be calculated using $\dot{I}_l$ and the various constants of the induction motor 6. To the contrary, when the voltage $\dot{V}$, the current $\dot{I}_l^*$, and the constants except the resistance $r_2$ are known, the resistance $r_2$ of the secondary coil can be evaluated by reversely calculating Eq. (9). Therefore, the microcomputer 13 reversely calculates Eq. (9) by the use of the voltage output $\dot{V}$ applied from the voltage detector circuit 15, the primary current command value $\dot{I}_l^*$, and the aforementioned constants. Using the secondary resistance $r_2$ thus evaluated, the microcomputer calculates the current command value again so as to control the operation of the induction motor 6 through the PWM circuit 14 as well as the transistor inverter 4 as described before.

Although the secondary resistance $r_2$ can be evaluated by reversely calculating Eq. (9), a table method wherein a table with the values of the secondary resistance $r_2$ calculated on the basis of the values of the voltage $\dot{V}$ is prepared beforehand and is used for obtaining the secondary resistance $r_2$ is adopted as a practical calculation method in order to shorten a computing period of time.

Figure 3:
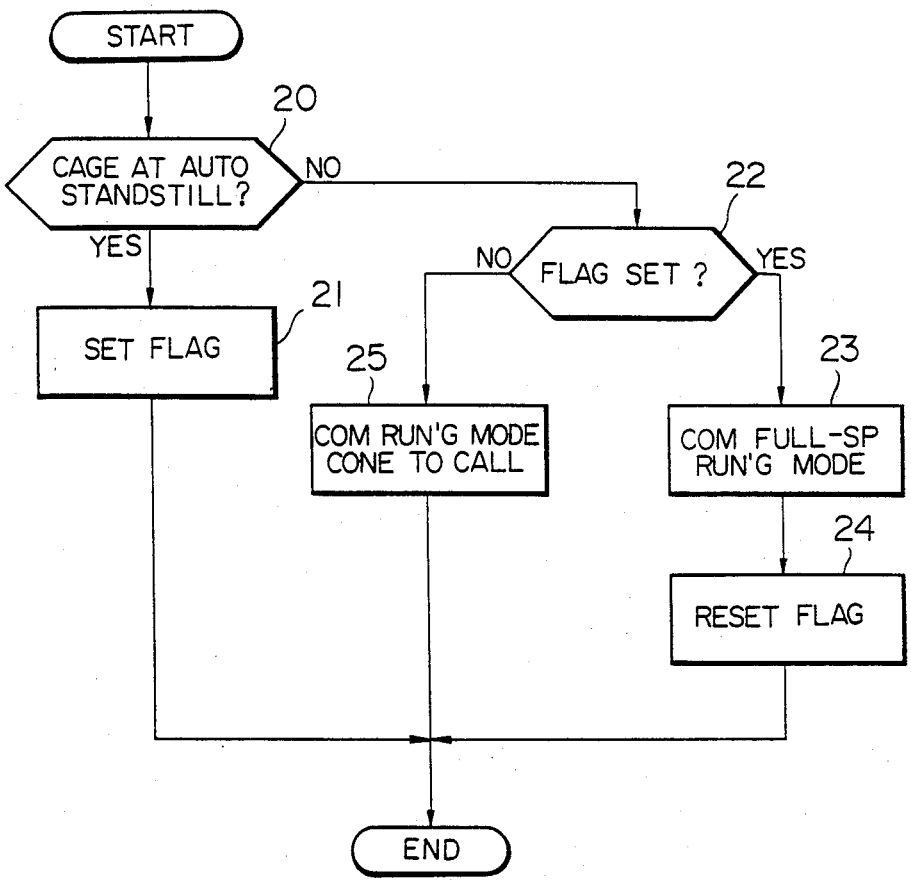
FIG. 3 is a flow chart showing a start-up control for a cage after an automatic standstill.

Meanwhile, when the cage is at an automatic standstill, the temperature of the induction motor 6 lowers in proportion to the period of time of the standstill. When a call for the cage is subsequently generated, the secondary resistance $r_2$ often has a value which is greatly different from a value before the automatic standstill. If the cage is actuated under such a state, the induction motor 6 will undergo a torque reaction from the start-up time of the cage till the full-speed operation thereof, whereby a comfortable ride will not be provided to the passengers in the cage 9. Therefore, the pattern generating device 12 is furnished with a microcomputer 16 for providing the command of a full-speed running mode. This microcomputer 16 executes calculations shown in FIG. 3 so as to forcibly run the cage at a maximum rated speed (hereinafter referred to as a full speed), thereby to correct the secondary resistance. Referring to FIG. 3, while the cage is at an automatic standstill, a flag indicative of the automatic standstill is set (steps 20, 21). When the cage is to be subsequently started, whether or not the flag of the automatic standstill is set is decided (step 22). When the flag is set, the command of the full-speed mode is given to the pattern generating device 12 irrespective of a generated call (step 23). Thereafter, the flag of the automatic standstill is reset (step 24). In this manner, when the cage is to be started after the automatic standstill, it is once run at the full speed. When the flag is not set, a running mode conforming to the call is commanded (step 25). After the full-speed running, the automatic standstill flag is not set, so that when the cate is to be subsequently started, an operation mode corresponding to a call is commanded by the step 25.

Figure 4:
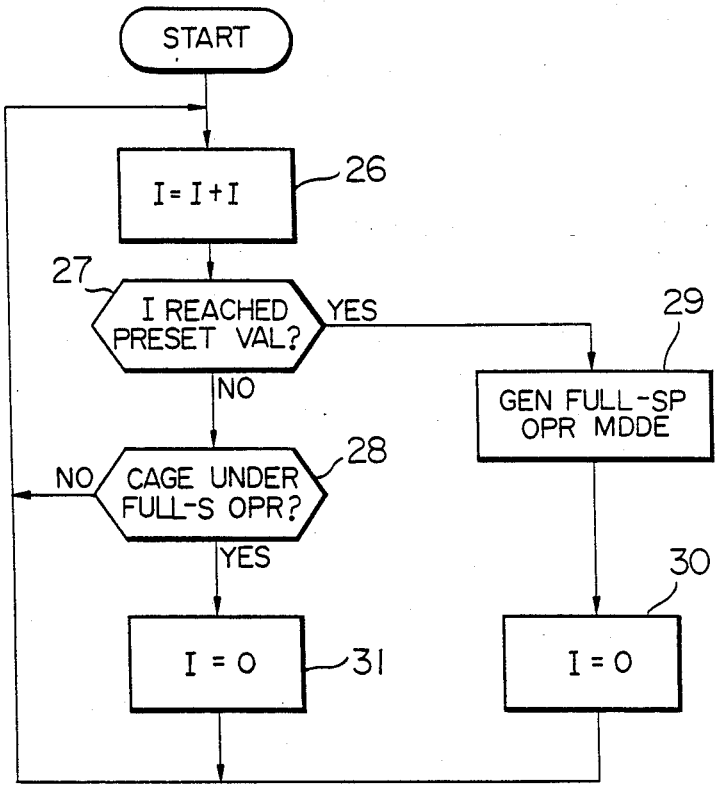
FIG. 4 is a flow chart showing a control in the case where a full-speed operation is not performed for a predetermined period of time.
Figure 5:
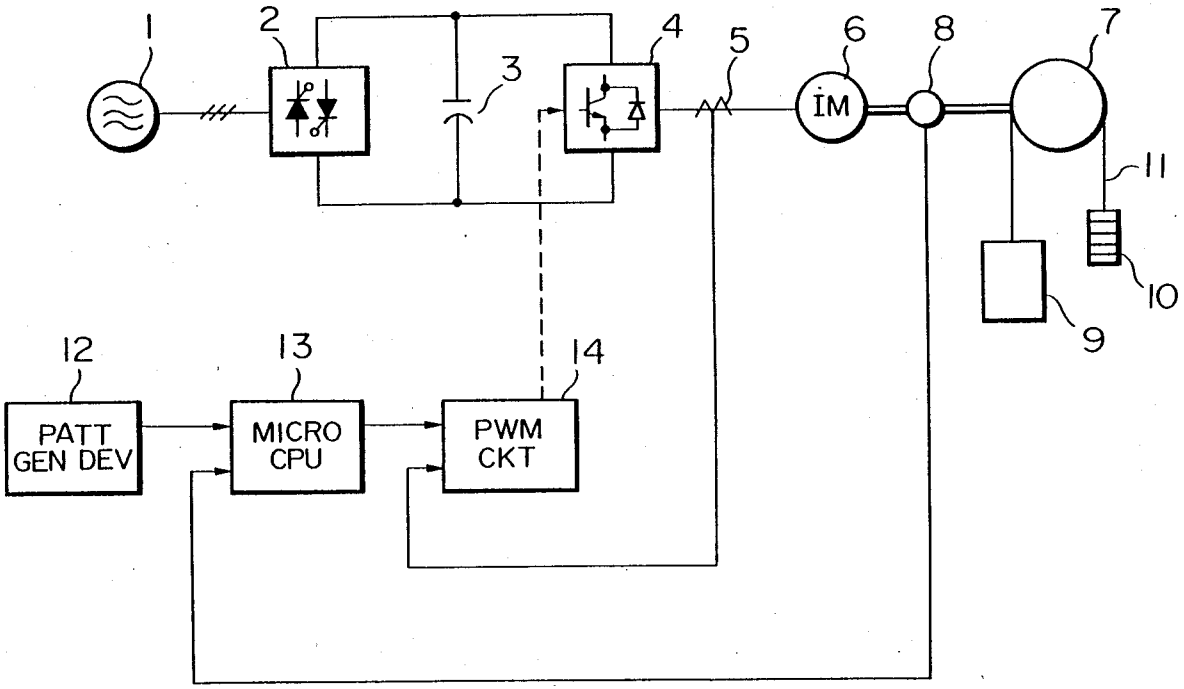
FIG. 5 (PRIOR ART)
FIG. 5 is a block diagram of a prior-art speed control apparatus for an elevator.

Besides, when the full-speed running is not performed for a long time in the operation of the elevator, the temperature of the induction motor 6 rises, the secondary resistance thereof becomes high, and the induction motor 6 is overexcited to worsen the control performance. Therefore, in consideration of such a case, the microcomputer 16 is endowed with a control function indicated in FIG. 4. More specifically, a variable I is provided, whereby unless the cage performs the full-speed operation, the variable I has 1 (one) added every predetermined time interval (steps 26, 28). When the variable I has reached a preset value through the addition (step 27), the full-speed running mode is forcibly generated (step 29), and the secondary resistance of the induction motor 6 is corrected. After the generation of the full-speed operation mode, the variable I is set to 0 (zero) (step 30). Also when at the step 28 it is decided that the cage is under the fullspeed operation, the variable I is set to 0 (step 31).

Although, in the above embodiment, the microcomputer 16 is separately disposed as the control means, the respective functions can also be realized by the microcomputer 13.

As described above, according to this invention, an apparatus for controlling the speed of a cage by calculating the command value of a primary current in each phase is provided with means to detect the voltage of an induction motor, and an actual secondary resistance is evaluated with the detected voltage so as to calculate the command value of the primary current. This brings forth the effect that the insufficient torque and overexcitation of the induction motor can be prevented to perform a speed control of high precision appropriate for an actual running situation.

What is claimed is:

1. In an elevator system having a converter for converting alternating current supplied from a power source into direct current and an inverter for inverting the direct current into primary current to drive a hoisting induction motor, a speed control apparatus comprising:

(a) voltage detection means for detecting a terminal voltage of the induction motor and for generating an output representative thereof, (b) control means for determining a reference value of he primary current in accordance with a secondary resistance of the induction motor so as to drive the induction motor at a rated speed and for controlling the inverter so that the primary current inverted by the inverter is changed to become equal to the reference value, said control means including:

(i) decision means for deciding whether or not the induction motor is operating at a rated speed, and (ii) means operating when said decision means has decided the induction motor is operating at the rated speed to receive the output of the voltage detection means and to calculate the secondary resistance of the induction motor on the basis of the received output so as to determine the reference value of the primary current to drive the induction motor at the predetermined speed.

2. In an elevator system having a converter for converting alternating current supplied from a power source into direct current and an inverter for inverting the direct current into primary current to drive a hoisting induction motor, a speed control apparatus comprising:

(a) voltage detection means for detecting a terminal voltage of the induction motor and for generating an output representative thereof, (b) control means for determing a reference value of the primary current in accordance with a secondary resistance of the induction motor so as to drive the induction motor at a rated speed and for controlling the inverter so that the primary current inverted by the inverter is changed to become equal to the reference value, said control means including:

(a) first decision means for deciding whether or not a cage is in a standstill state, (c) second decision means operating in response to an output of said first decision means to decide whether or not said cage has started from the standstill state, and (c) means operating in response to an output of said second decision means to generate a command to run the cage at a full maximum rated speed by calculating the secondary resistance of the induction motor.

3. A speed control apparatus for an elevator as defined in claim 2 further comprising memory means for storing the output of said first decision means.

4. A speed control apparatus for an elevator as defined in claim 3 wherein contents of said memory means are erased when the cage is running at the maximum rated speed.

5. A speed control apparatus for an elevator as defined in claim 2 wherein said control means further comprises means for generating a command to run the cage at the maximum rated speed in response to the output of said second decision means indicating that the start of the cage is not after the standstill state.

6. A speed control apparatus for an elevator as defined in claim 1 wherein said control means further includes means to detect a state in which an elevator cage does not run at the maximum rated speed for a predetermined period of time, and means operating in response to an output of the detection means to generate a command to run the cage at the maximum rated speed by calculating the secondary resistance of the induction motor.

7. A speed control apparatus for an elevator as defined in claim 6 wherein said detection means changes a computation value every predetermined time interval during which the cage does not run at the maximum rated speed and generates an output when the computation value reaches a preset value.

8. A speed control apparatus for an elevator as defined in claim 7 wherein when the cage runs at the maximum rated speed, said detection means resets the computation value and thereafter starts a computing operation anew.

* * * * *